US005123269A

United States Patent [19]

Müller

[11] Patent Number: 5,123,269

[45] Date of Patent: Jun. 23, 1992

[54] CANTILEVERED SLIT-STRAND ROLLING MILL WITH ROLL CHANGING DEVICE

[75] Inventor: Alfred Müller, Meerbusch, Fed. Rep. of Germany

[73] Assignee: SMS Schloemann-Siemag Aktiengesellschaft, Düsseldorf, Fed. Rep. of Germany

[21] Appl. No.: 624,977

[22] Filed: Dec. 10, 1990

[30] Foreign Application Priority Data

Dec. 9, 1989 [DE] Fed. Rep. of Germany ..... 3940736

[51] Int. Cl.[5] ..... B21B 1/18

[52] U.S. Cl. ..... 72/204; 72/235; 72/239

[58] Field of Search ..... 72/203, 204, 234, 237, 72/238, 239, 366.2, 235

[56] References Cited

U.S. PATENT DOCUMENTS

| | | | |
|---|---|---|---|
| 1,833,376 | 11/1931 | Simmons | 72/239 |
| 3,587,277 | 6/1971 | Pigni et al. | 72/234 |
| 3,683,662 | 8/1972 | Dechene et al. | 72/366.2 |
| 3,774,433 | 11/1973 | Pavels | 72/203 |
| 4,306,440 | 12/1981 | Demny | 72/234 |
| 4,357,819 | 11/1982 | Elley | 72/204 |
| 4,706,485 | 11/1987 | Gilvar et al. | 72/239 |
| 4,726,108 | 2/1988 | Poloni | 72/239 |
| 4,779,439 | 10/1988 | Baldi | 72/366.2 |
| 4,922,740 | 5/1990 | Poloni et al. | 72/237 |

*Primary Examiner*—Lowell A. Larson
*Assistant Examiner*—Thomas C. Schoeffler
*Attorney, Agent, or Firm*—Toren, McGeady & Associates

[57] ABSTRACT

A high-speed rod and wire mill, particularly for single-strand, twist-free rolling. The mill includes a roughing train, at least one intermediate train and a subsequent finishing train, wherein each of the trains includes several rolling mill stands or rolling units. A finishing stand set may follow the finishing train. For a minimized series of passes in each train section, the roughing train has a crane tool for exchanging the rolls, the intermediate train has a manipulator for exchanging the rolls and the finishing train has a quick-exchange device for changing the rolls and possibly an additional manipulator. All rolling mill stands or rolling units in the individual train sections have overhung-mounted and removable rolls, so that the yield of the mill is increased.

7 Claims, 8 Drawing Sheets

CANTILEVERED SLIT-STRAND ROLLING MILL WITH ROLL CHANGING DEVICE

BACKGROUND OF THE INVENTION

1. Field of the Invention

The present invention relates to a high-speed rod mill and wire mill for single-strand, twist-free rolling of material. The rod mill and wire mill includes a roughing train, at least one intermediate train and a subsequent finishing train, wherein each of the trains include several rolling mill stands or rolling units, and possibly a subsequent finishing stand set.

2. Description of the Related Art

The development of rolled wire production has been very rapid in recent years due to the use of new technologies, such as, Morgan blocks and Stelmor cooling units. For example, the maximum speeds were increased from about 35 m/s to more than 100 m/s; the initial pass cross-sections were increased from 80 mm diameters to up to 150 mm diameters. The collar sizes were increased threefold. As a consequence of this development, it was possible to switch from four-strand and three-strand trains to two-strand or single-strand trains with all the attendant advantages with respect to yields and utilization of the production plants.

Concerning the arrangement of the rolling mill stands it is to be noted that in the case of normal steel qualities the continuous horizontal stand arrangement was chosen for the roughing train as well as for the intermediate train particularly in the case of contemplated multiple-strand rolling. In this arrangement, it is necessary to twist between the stands depending upon the pass shape. The requirements made with respect to surface quality and tolerances in most cases permit such a manner of operation.

In those cases in which higher requirements are made, the intermediate trains are frequently split and are equipped with stands in horizontal/vertical arrangement with the appropriate units for tension-free rolling. This is particularly important for the production of Garret sizes with good surfaces and tolerances.

For moderately alloyed steels and high-alloy steels and grades with particular surface qualities, a horizontal/vertical arrangement is needed for the entire rolling mill train because these qualities in most cases no longer permit twisting. In order to be complete, it is noted that for obtaining a good surface quality, roller guides are usually used between the stands.

Depending on the wire qualities to be rolled, various twist-free finishing stand set constructions were also developed. The individual horizontal/vertical roll units of the finishing stand sets have cantilevered hard metal collars.

With respect to the present situation of the technological development of wire mills it is to be noted that these mills more and more must be developed in accordance with the specific requirements of the operator because the degree of utilization of the wire mill should be increased and the wire mill should be adaptable to the respective production programs. Also, the yields are to be increased and the high quality of the product is to be ensured.

SUMMARY OF THE INVENTION

It is, therefore, the primary object of the present invention to optimize the individual train sections of the rod mill and wire mill. In particular, the availability of the mill is to be increased, the wire or rod steel is to be rolled without twisting in all train sections and the plant costs are to be reduced by the optimized use of stands with certain predetermined properties.

In accordance with the present invention, in a high-speed rod mill and wire mill of the above-described type, the roll exchange takes place in accordance with the minimized series of passes in each train section. The exchange is carried out in the roughing train by means of a crane tool, in the intermediate train by means of a manipulator and in the finishing train by means of a quick-exchange device, wherein all rolling mill stands or rolling units in the individual trains sections have cantilevered rolls.

Since the entire rolling mill train is equipped with rolling mill stands or rolling units with cantilevered roll shafts onto which the collars are mounted, short exchange times are possible i.e., long reassembly times are no longer required, so that the train is practically continuously ready for rolling. No looping stands are necessary. Since the roll exchange is provided in accordance with the minimized series of passes, the roll exchange can be carried out as frequently as necessary and as required by the wear conditions and the quality to be ensured, wherein the most suitable exchange devices are used in each train section, and wherein the exchange devices are adapted in an optimum manner to the exchange process and take into consideration the roll weight. As a result, twist-free rolling of the material is possible in the entire rolling mill train with high yield and a rolled product of high grade and quality.

In accordance with a further development of the invention, in order to obtain twist-free rolling of the material the roughing train and the intermediate train have horizontal and vertical compact stands in alternating sequence, the finishing train has in the rolling direction first horizontal and vertical compact stands followed by a stand set including a vertical and a horizontal rolling unit, wherein the horizontal rolling unit is utilized exclusively for separation rolling of the material into two separate strands while the vertical rolling unit is utilized for normal rolling of the material, and the finishing stand set is composed of several horizontal and vertical rolling units.

The above-described arrangement of the individual train sections provides several advantages. The size of the area required for setting up the stands is minimized. The total length of the rolling mill train is reduced because the compact stands can be positioned closely next to each other. Also, no roller conveyors between the stands are necessary. Due to the standardization of the optimized roll exchange, the number of replacement parts which have to be stored is low. The exchange periods are reduced.

Particularly advantageous is the use of a two-stand vertical/horizontal miniset with cantilevered rolls which replace the previously used tilting and rotating stands when, for example, the single-strand rolled material is to be subjected to a separation rolling. This is because in the case of separation rolling of the material, only the horizontal rolling unit of the stand is in use for the separation pass, while only the vertical rolling unit is in operation in the case of normal rolling. The respectively other rolling unit is operated idly or the respective rolling unit is taken out.

In accordance with a further development of the invention, the horizontal/vertical roll stand set for the last passes of separation rolling is followed by two two-high roll stands with a rolling sequence from oval pass to round pass. Thus, when the horizontal rolling unit of the horizontal/vertical roll stand set in the finishing train is used for separation rolling of the material (the vertical rolling unit of the roll stand set does not perform rolling work), each strand of the material separated into two strands is finish rolled in the horizontal stand by means of rolls which each have two passes, until the shaped material can subsequently be conveyed onto the cooling bed as finished rod steel.

In accordance with another advantageous development of the invention, the vertical/horizontal roll stand set of the finishing train for the last passes of separation rolling is followed by two compact rolling stand sets each including a horizontal rolling unit and a vertical rolling unit. The use of two two-stand compact roll stand sets for the two last passes after separation rolling of the material makes it possible to replace the usually arranged horizontal two-high stands. As a result, each strand of material is rolled twist-free. Accordingly, even in the case of separation rolling, the entire rolling train can be equipped with cantilevered collars. In addition, hard metal collars with long service lives can be used. The exchange time and the maintenance times of the rolling train can be even further reduced. The use of compact stands results in a short length of the finishing train and, thus, the finishing train requires less space.

In order to reduce the exchange times or maintenance times in the roughing train or to increase the yield in this train section, another proposal of the invention provides a C-shaped, angular support tool which is pivotally fastened to a crane bridge. The support tool is used for exchanging the collars at least of the horizontal compact stands. A common exchange unit for the collars is arranged at the lower center of gravity location of the support tool. Since the collars in this train section have a relatively high weight of about 150 to 450 kilograms, while having a comparatively long service life of several days at maximum permissible rolling outputs, the use of the proposed roll exchange unit is adapted in an optimum manner to the rolling technology in the roughing train with respect to the structural requirements as well as with respect to the time in which the exchange unit is used.

The same advantages are obtained in the intermediate train if, by appropriate adaptation to the rolling technology, the cantilevered collars of the stands are exchanged by means of a manipulator which can be moved to all sides and whose head supports the exchange unit for the collars of the compact stands and which can be controlled manually. Thus, since in this train section the weight of the collars are already substantially lower as compared to those in the roughing train, while, on the other hand, the average service life is also reduced, an exchange unit is provided which can be easily operated by the operating personnel and which permits a quick and exact exchange of the worn collars for new collars.

The advantage of the roll exchange in accordance with the minimized series of passes in each train section becomes particularly apparent in each train section of the finishing train if, in accordance with another proposal of the invention, a quick-exchange device is used in the finishing train. The quick-exchange device includes an exchange unit for the two corresponding collars of each vertical and horizontal stand. The exchange unit is raisable and rotatable and possibly displaceable and is mounted on a movable exchange carriage. In these train sections, the collars are subjected to high loads due to the high rolling speeds, among other reasons, and have an average service life of only about one to two days when operated under maximum rolling power, even when best materials are used, such as, tungsten carbide. The requirements of a quick and exact roll exchange which can be controlled from an operating position are met by the present invention with the use of the proposed quick-exchange device.

In accordance with another improved feature of the present invention, the roll exchange unit and at least two receiving units for an assembly frame which receives at least the collars, wherein the receiving units are pivotable about an axis of rotation. This makes it possible for the operating personnel to have new collars ready for assembly on a construction site, where the collars can be mounted in the receiving unit of the movable exchange unit. Subsequently, the receiving unit is pivoted accordingly and the worn collars are placed on the construction site for further handling. Subsequently, the exchange carriage is moved back into the train section. Accordingly, the individual procedures during roll exchange can be completely automated with conventional control and regulating elements.

In order to optimize the roll exchange in the finishing train, the present invention provides that the roll fittings can be mounted in the assembly frame and the corresponding collars can be fixed in operating position. This permits an even more complete preassembly on the construction site which further reduces the roll exchange time and leads to greater yield of the respective train section. The overall yield of the entire rod mill and wire mill is improved. In this regard, it is also advantageous if, in accordance with another proposal of the invention, the front plate has centering and clamping pieces for fixing the assembly frame on the front plate of the compact stand. An assembly frame equipped in this manner will be discussed in more detail below.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DESCRIPTION OF THE PREFERRED EMBODIMENT

Figure 1A:
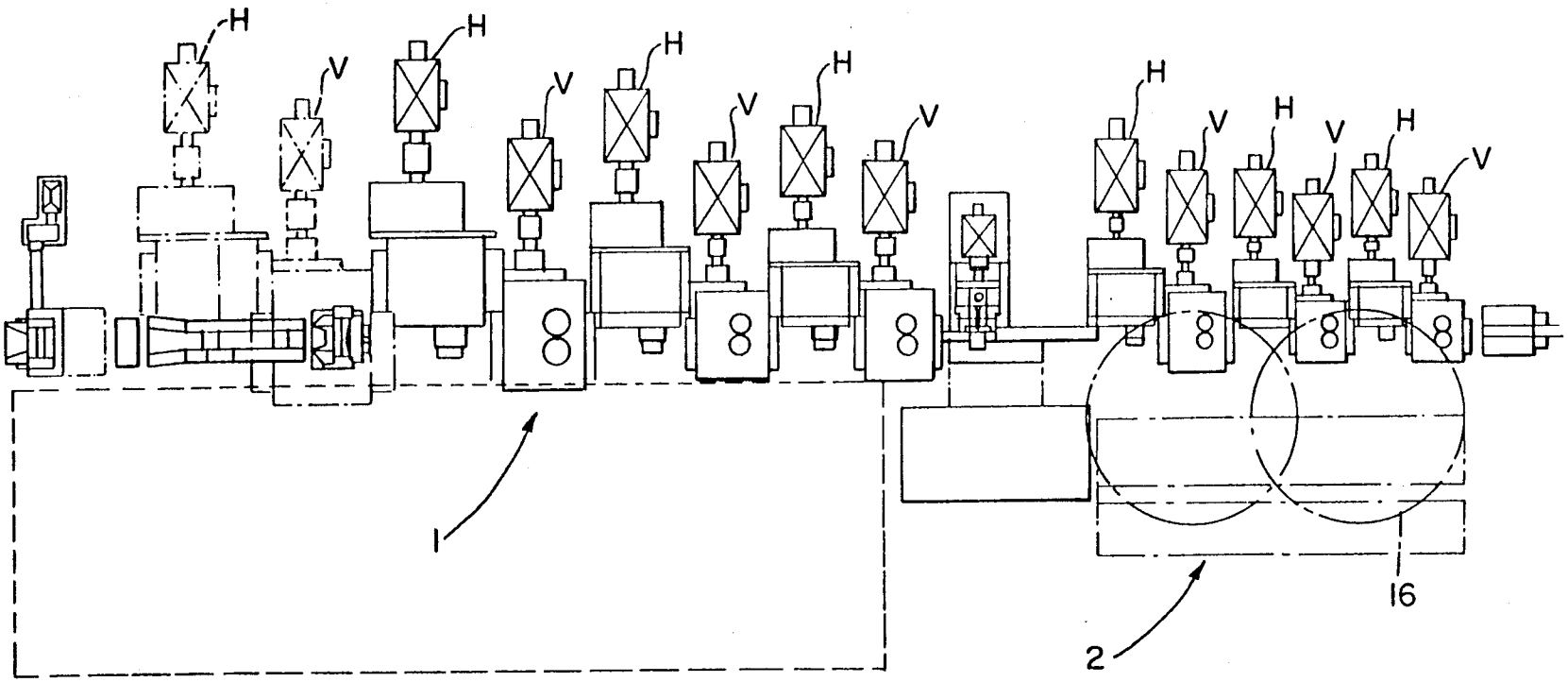
FIGS. 1*a*–1*c* show schematic illustrations of the layout of a rolling mill train.
Figure 1B:
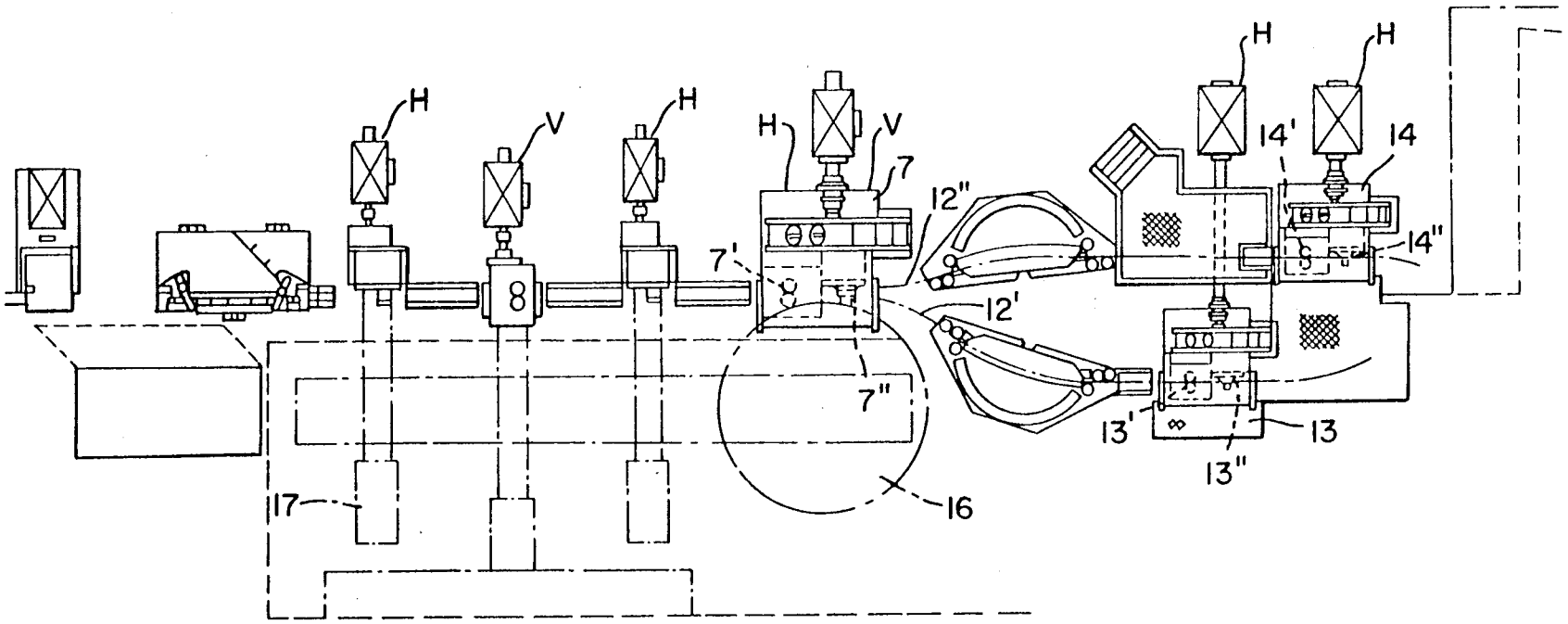
Figure 1C:
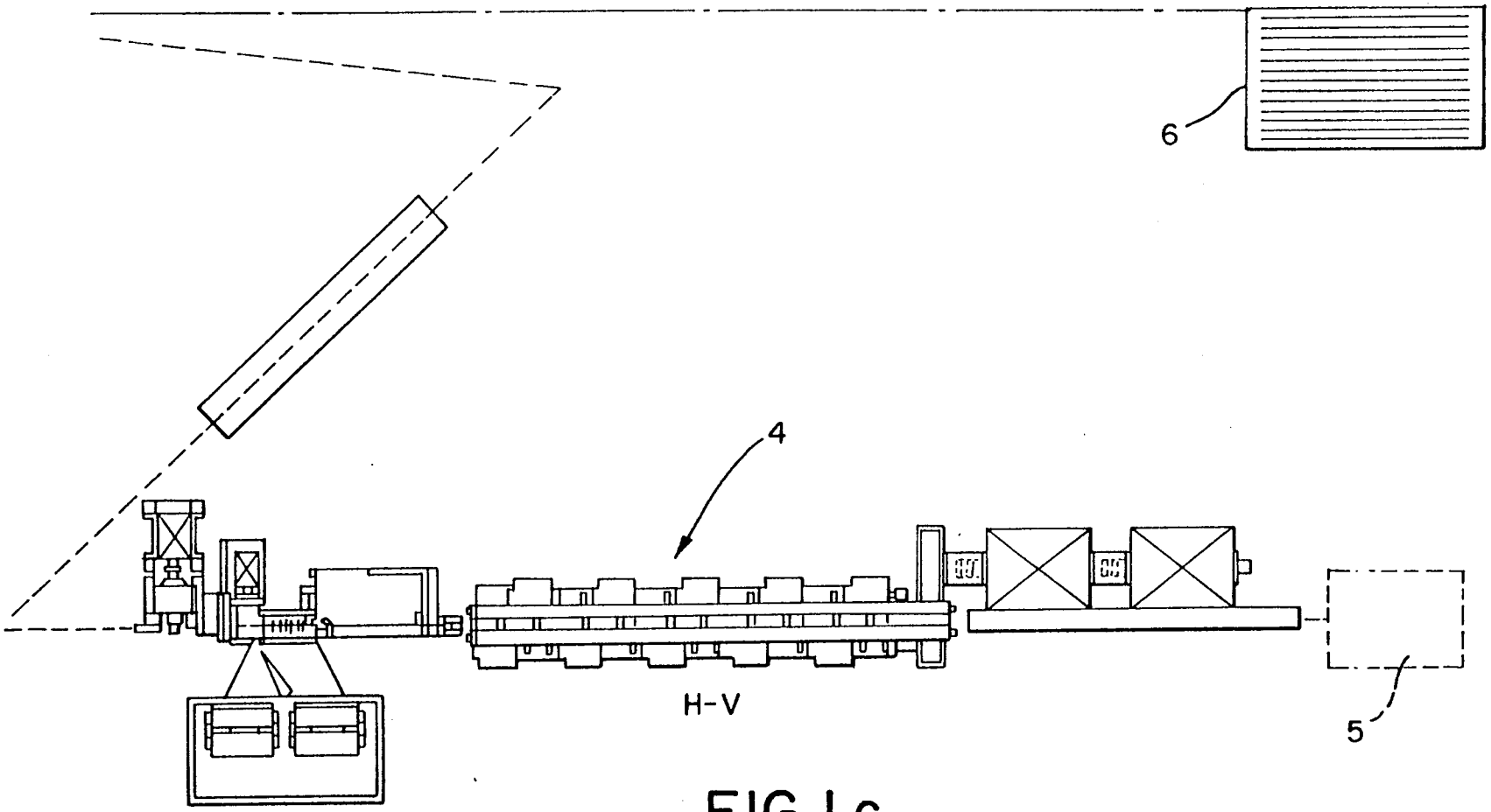

FIGS. 1*a*–1*c* of the drawing shows a high-speed rod mill and wire mill with a roughing train 1 which is composed of rolling mill stands which are arranged next to each other in the pitch line with a stand sequence of horizontal (H)/vertical (V). The roughing train 1 is followed by the intermediate train 2 which also is composed of rolling mill stands arranged next to each other with the stand sequence of horizontal (H)/vertical (V). A finishing train 3 is arranged following the intermediate train 2. The finishing train 3 which is the intermediate train when wire is manufactured is followed by a finishing stand set 4 with a cooling unit which is not shown in detail and which usually consists of a water cooling section with driver and coiling unit and the Stelmor unit. When rod steel is being manufactured, the finishing train 3 is followed by a cooling and runout bed 6.

Figure 2:
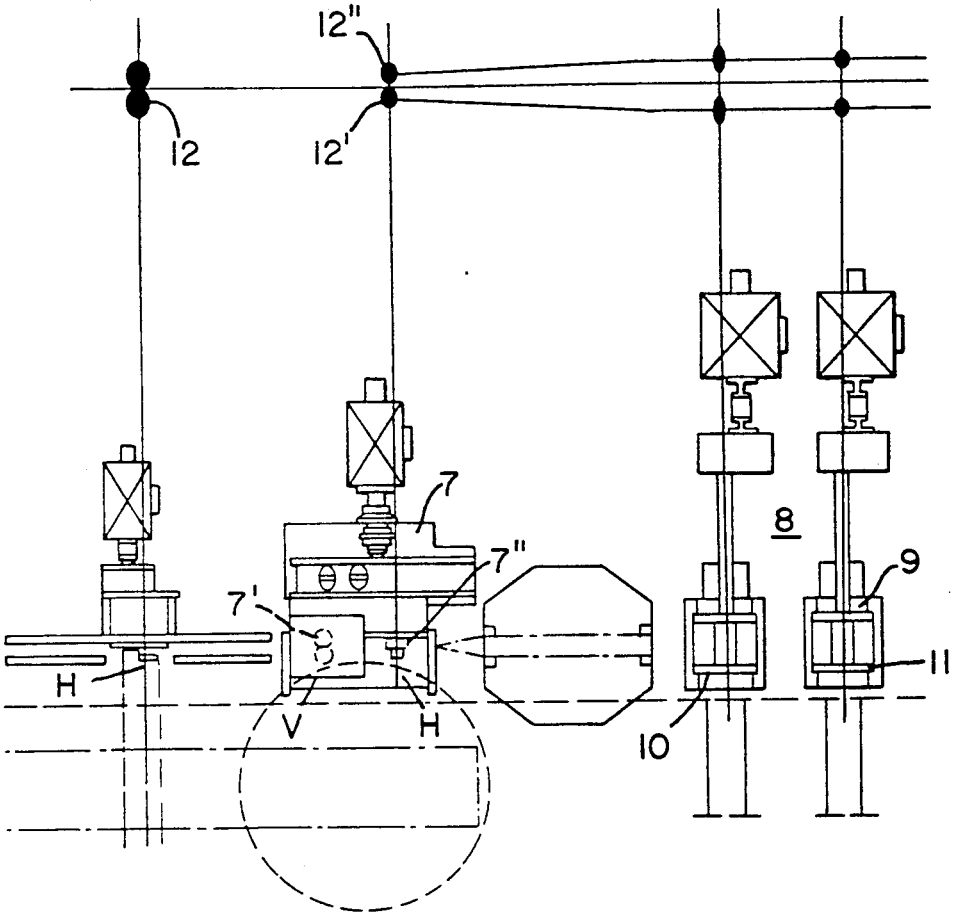
FIG. 2 is a schematic illustration showing the finishing train for separation rolling with two horizontal two-high stands.
Figure 3:
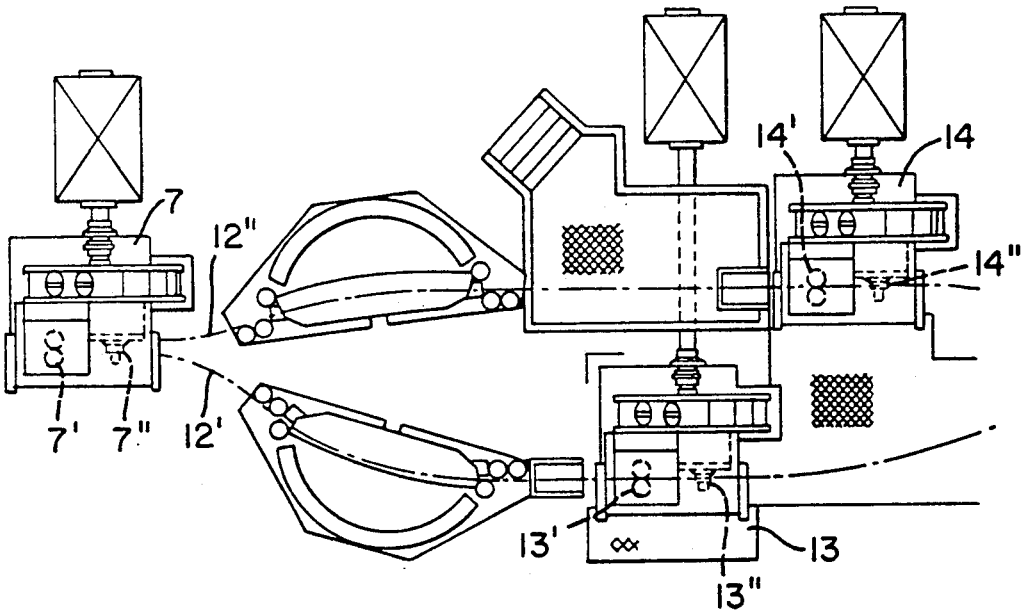
FIG. 3 is a schematic illustration showing the finishing train for separation rolling with two vertical/horizontal roll stand sets.

FIGS. 2 and 3 of the drawing show on a larger scale portions of the finishing train 3 in which three roll stands with the stand sequence horizontal/vertical/-horizontal are followed by a roll stand set 7 which is composed of two rolling units with the sequence vertical/horizontal. As shown in FIG. 2, the vertical/horizontal roll stand set 7 is followed by two horizontal two-high stands 8. The rolls 9 of these two-high stands each have at least two passes 10, 11. As illustrated in the drawing, a separation rolling of the material 12 from a single strand into two strands 12', 12'' takes place in the horizontal rolling unit 7'' of the roll stand set 7. Each of the two strands 12', 12'' is subsequently subjected to an oval/round rolling in the two subsequently arranged horizontal stands 8. It is noted in this regard that, when separation rolling is performed, the vertical rolling unit 7' of the roll stand set 7 runs idly or the appropriate set of rolls is removed.

FIG. 3 of the drawing shows that when the material 12 is subjected to separation rolling by means of the horizontal rolling unit 7'' of the roll stand set 7, two two-stand roll stand sets 13, 14 are provided. In other words, a roll stand set 13 or 14 is provided for each stand 12' or 12''. Each roll stand set 13, 14 has two rolling units 13, 13''; 14', 14'' with the rolling sequence vertical/horizontal.

The vertical/horizontal roll stand set 7 in the finishing train 3 replaces the tilting or rotating stands usually used in this location. The vertical/horizontal roll stand sets 13, 14 replace the horizontal two-high stands illustrated in FIG. 2.

All roll stands in the rolling mill train, particularly as illustrated in FIGS. 1*a*–1*c* in connection with FIG. 3, have cantilevered shafts onto which the collars can be mounted. This makes it possible to carry out the roll exchange in accordance with the minimized pass series in each train section. Specifically, the exchanges are carried out in the roughing train by means of crane tools (FIGS. 4*a*–4*c*), in the intermediate train by means of manipulators (FIGS. 5*a*–5*b*) and in the finishing train by means of quick-exchange devices (FIGS. 6*a*–6*b*).

Figure 4A:
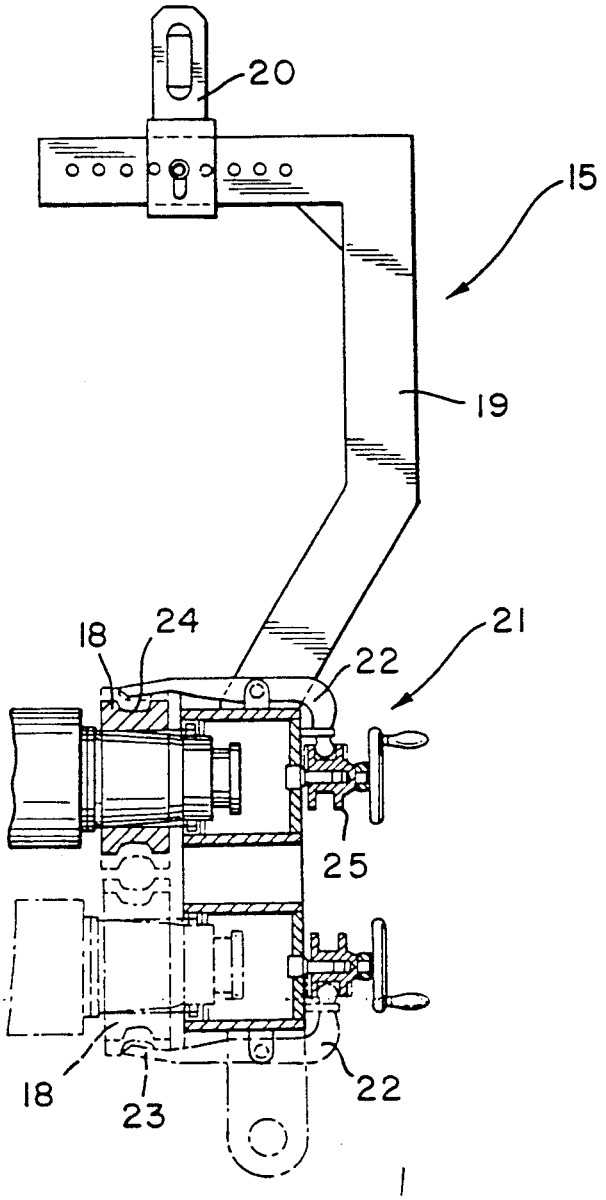
FIGS. 4*a*–4*c* show schematic illustrations of the roll exchange device for the roughing train.
Figure 4C:
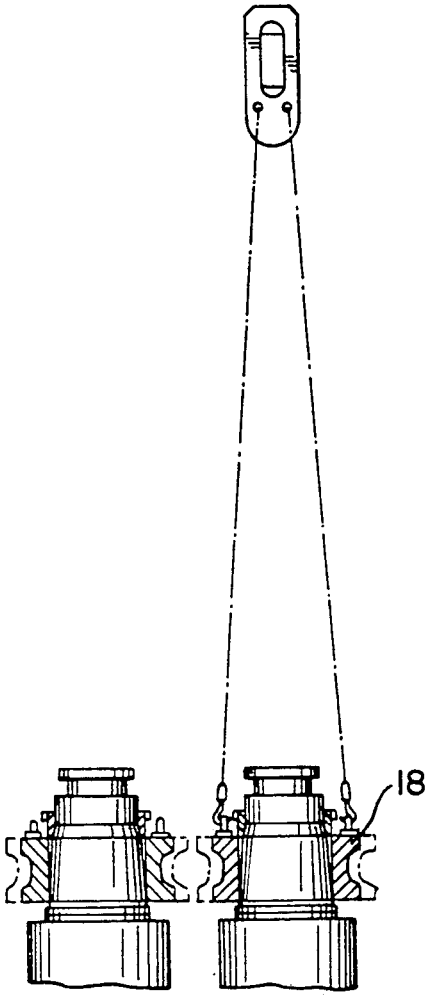
Figure 4B:
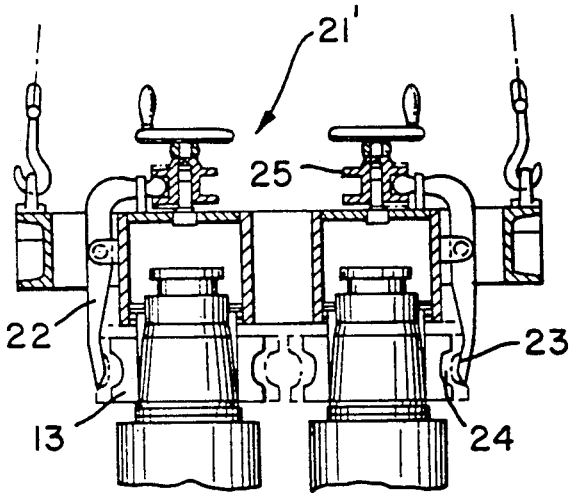

As illustrated in FIGS. 4*a*–4*c* the crane tools 15 for exchanging the collars 18 particularly of the horizontal stands in the roughing train 1 shown in FIGS. 4*a*–4*c* include a C-shaped support tool 19 which is pivotally suspended on a crane bridge 20. A handwheel-operated roll exchange device 21 is arranged at the lower center of gravity position of the support tool. This roll exchange device 21 receives the corresponding collars 18 of the roll stands. For this purpose, a lever system 22 with a projection 23 at the end thereof is provided. The projection 23 engages in the pass 24 of the collars 18 when the handwheel is rotated and the guide nut 25 is thereby moved in longitudinal direction. As shown in FIG. 4*b*, the roll exchange device 21' for the collars of the vertical stands can be raised, for example, in a conventional arrangement by means of the ropes of a crane. In the simplest case, as shown in FIG. 4*c*, it is also possible that the crane ropes are fastened directly to the collars.

Figure 5A:
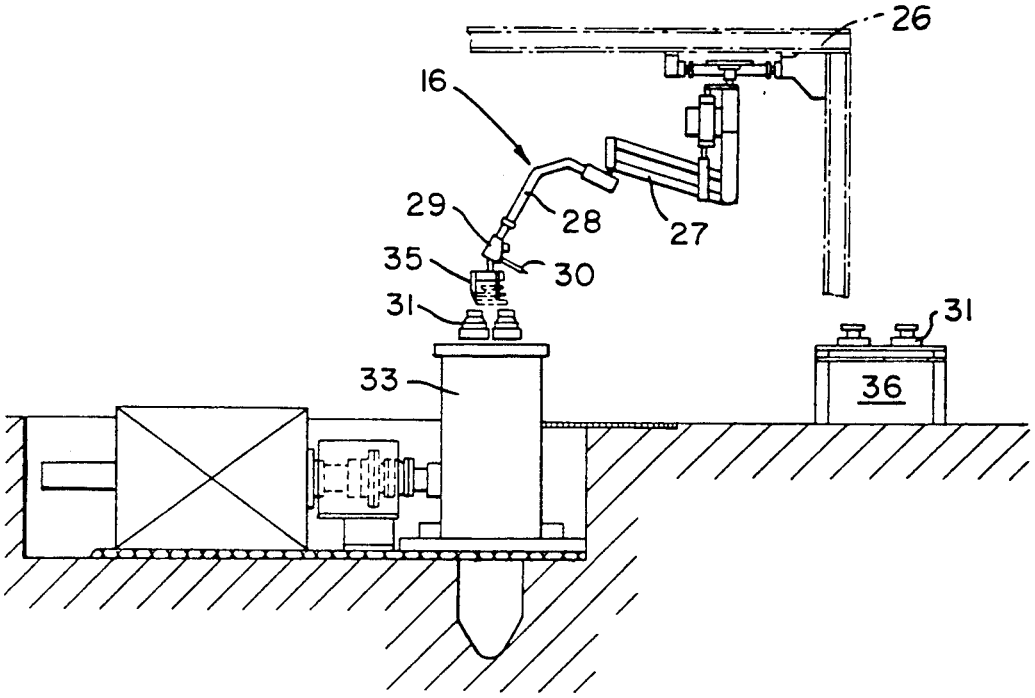
FIGS. 5*a*–5*b* show schematic illustrations of the roll exchange device for the intermediate train.
Figure 5B:
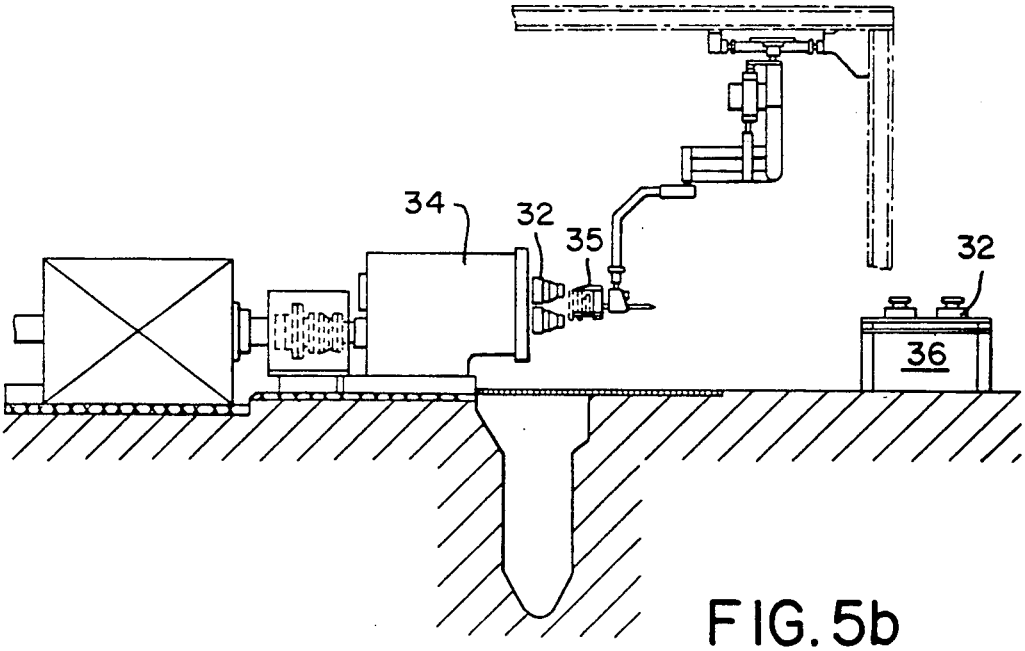

FIGS. 5*a*–5*b* of the drawing shows the use of a manipulator 16 for exchanging the collars 31, 32 of a vertical compact stand 33 (FIG. 5*a*) or of a horizontal compact stand 34 (FIG. 5*b*) in the intermediate train 2. The manipulator 16 is fastened to a support bridge 26 and can be connected to a hydraulic system which is not illustrated in detail. The manipulator is essentially composed of articulated link systems 27, 28, so that the head 29 of the manipulator which carries the exchange unit 35 for the collars 31, 32 can be moved in all directions. The head 29 of the manipulator 16 can be controlled by the operating personnel by means of a control lever 30 in all directions of movement, so that the collars 31, 32 can be pulled off from the respective roll stand in a very short time and can be replaced by new collars 31', 32' which are made available on the construction site 36.

Figure 6A:
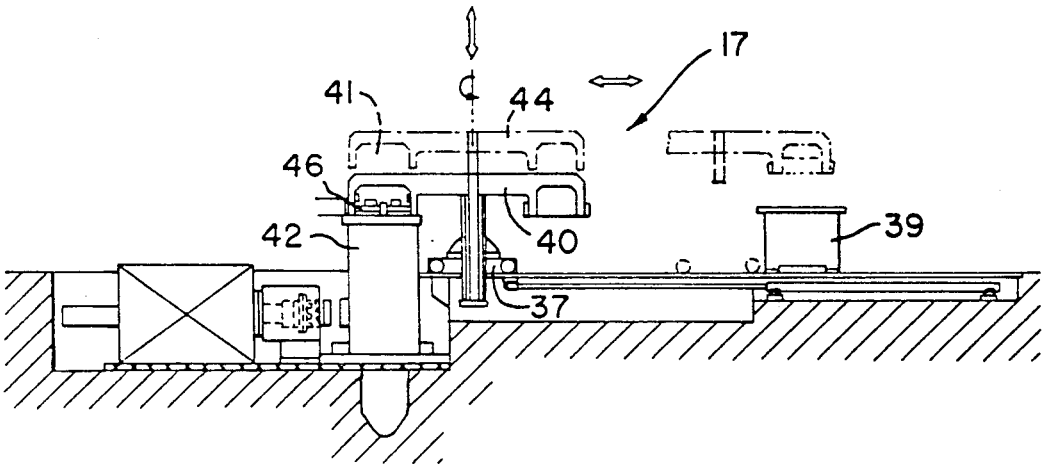
FIGS. 6*a*–6*b* show schematic illustrations of the roll exchange device for the finishing train.
Figure 6B:
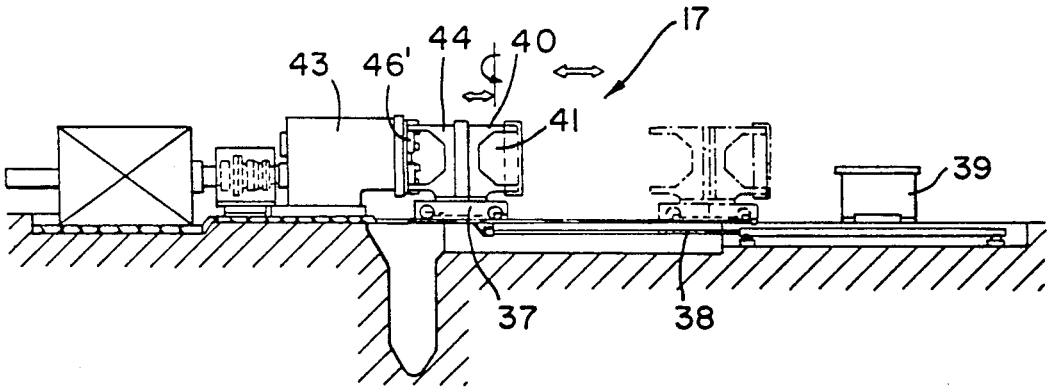

As shown in FIGS. 6*a*–6*b*, a quick-exchange device 17 is provided for exchanging the collars 46 in the finishing train 3. The quick-exchange device 17 includes an exchange carriage 37 which is movable by means of a piston-cylinder linkage 38 on a conventional rail arrangement between the roll stands 42, 43 and a construction site 39. The exchange device includes a raisable and rotatable receiving unit 40 whose possible movements are indicated by arrows and which, as shown in FIG. 6*a*, has two diametrically oppositely located roll supports 44 which each have a receiving opening 41 at least for the corresponding collars 46 of the vertical compact stand 42. One of the receiving openings may support the worn collars of the roll stand 42, while the other receiving opening receives the new collars which have been prepared on the site 39. As shown in FIG. 6*b*, the receiving device 40 for the collars of the horizontal compact stand 43 are constructed slightly differently. Thus, the two oppositely located roll supports 44 are arranged on the exchange carriage as indicated by the arrow to such an extent that sufficient space is provided for assembling or disassembling the collars when the receiving device 40 is rotated appropriately on the exchange carriage.

Figure 7:
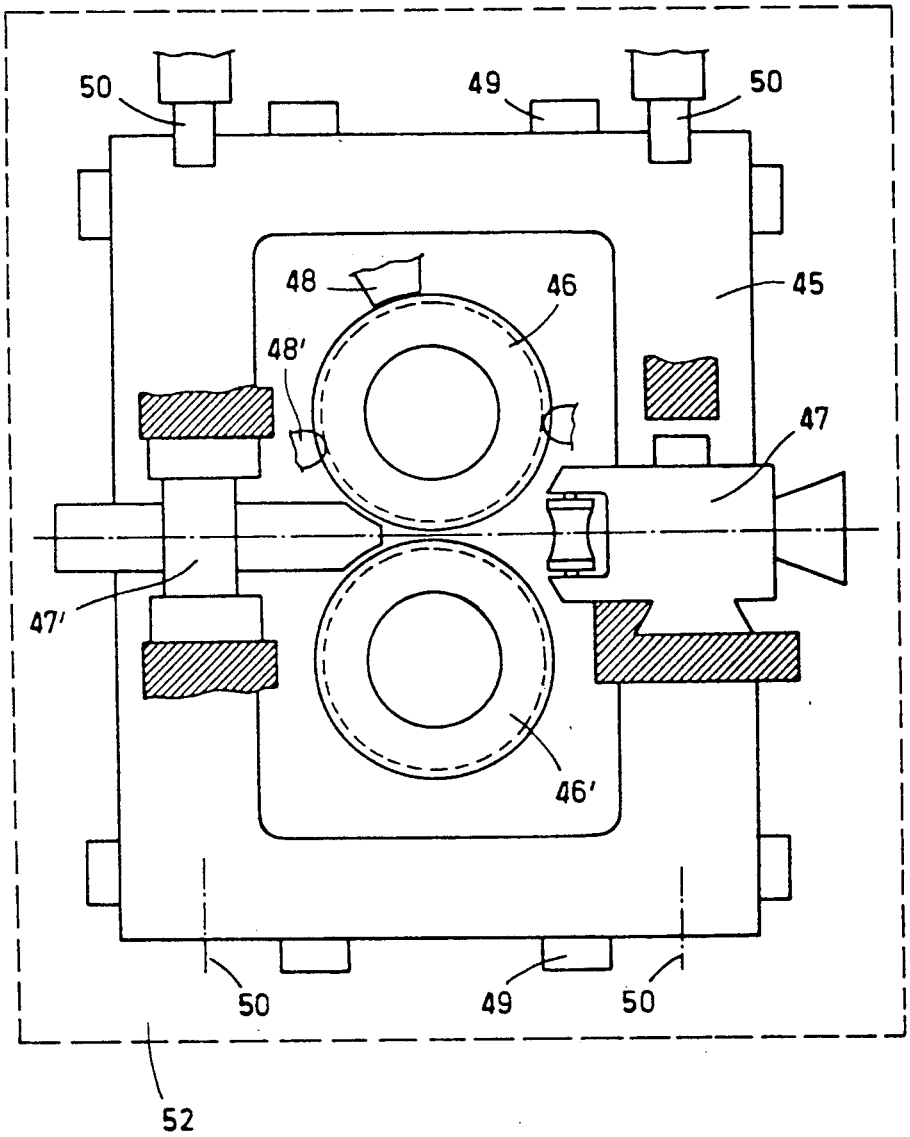
FIG. 7 is a sectional view of the assembly frame for the roll exchange device of FIGS. 6*a*–6*b*.

A particularly advantageous assembly system is shown in FIG. 7. The assembly system of FIG. 7 includes an assembly frame 45 which can be placed in the receiving opening 41 of the quick-exchange device 17 of FIGS. 6*a*–6*b*. The corresponding collars 46, 46' are fixed in mounting position and, thus, in operating position in the assembly frame 45. In addition, the roll fittings 47, 47' of the entry side and the exit side are fixedly mounted in the assembly frame. The collars are fixed in mounting position by means of a conventional lever system, not shown in detail, whose assembly hooks 48, 48' are positioned safely at the circumference of each collar or at the pass of each collar. Centering pieces 49 and clamping unit 50 are provided at the front plates 52. These measures serve for centering and fixing the assembly frame on the front plate of the respective compact stand of the finishing train 3. Thus, the quick-exchange device for the collars shown in FIGS. *6a–6b* can be used even more effectively by means of the assembly frame 45 shown in FIG. 7.

In accordance with the invention, it is possible to increase the usefulness of a rod mill and wire mill with high yields and excellent product quality by predominantly using in all train sections roll stands or rolling units with overhung mounted shafts and removable collars and by adapting the roll exchange devices exactly in accordance with the necessity and frequency of the roll exchange conditions.

While a specific embodiment of the invention has been shown and described in detail to illustrate the application of the inventive principle, it will be understood that the invention may be embodied otherwise without departing from such principles.

I claim:

1. In a high-speed rod and wire rolling mill for twist-free rolling, the rolling mill including a roughing train, at least one intermediate train and a subsequent finishing train, wherein the trains include several rolling mill stands, the improvement comprising the rolls of all rolling mill stands in the roughing train, in the intermediate train and in the finishing train being cantilevered and removable, wherein, for twist-free rolling, the roughing train and the intermediate train have horizontal stands and vertical stands in alternating sequence, the finishing train has in rolling direction first horizontal stands and vertical stands followed by a stand set including a vertical rolling unit and a horizontal rolling unit, wherein the horizontal rolling unit is used exclusively for separation rolling into two separate strands, wherein the vertical rolling unit is utilized for normal rolling, and wherein the stand set including the vertical and horizontal rolling units of the finishing train is followed for last passes of separation rolling in the finishing train by two two-high roll stands having a rolling sequence from an oval pass to a round pass.

2. The rolling train according to claim 1, comprising a finishing stand set following the finishing train.

3. The rolling train according to claim 2, wherein the stand set including the vertical and horizontal rolling units of the finishing train is followed for last passes of separation rolling in the finishing train by two compact rolling stand sets which each include a horizontal rolling unit and a vertical rolling unit.

4. The rolling train according to claim 3, wherein the roll exchange device includes at least two receiving units for an assembly frame which receives at least the collars, the receiving units being pivotable about an axis of rotation.

5. The rolling train according to claim 4, wherein roll fittings are mounted in the assembly frame and the collars are securable in a rolling position.

6. The rolling train according to claim 4, wherein each compact stand has a front plate, the front plate having centering and clamping members for mounting the assembly frame on the front plate.

7. The rolling train according to claim 1, wherein, for a minimized series of passes in each train section, the roughing train has a crane tool for exchanging the cantilevered and removable rolls of the roughing train, the intermediate train has a manipulator for exchanging the cantilevered and removable rolls of the intermediate train, and the finishing train has a roll changing device for exchanging the cantilevered and removable rolls of the finishing train, wherein the roughing train includes a C-shaped support tool, the support tool being pivotally mounted on a crane bridge, the support tool having a lower center of gravity location, wherein a common exchange unit for collars of at least the horizontal stands is arranged at the lower center of gravity location, wherein the manipulator of the intermediate train is movable to all sides and includes a head, the manipulator being manually controllable, wherein the head supports an exchange device for collars of the stand, and wherein the roll exchange device for two corresponding collars of each vertical stand and horizontal stand in the finishing train is mounted so as to be raisable and rotatable and is arranged on a displaceable exchange carriage.

* * * * *